United States Patent [19]

Tunstall

[11] Patent Number: 4,828,266

[45] Date of Patent: May 9, 1989

[54] GOLF CLUB

[76] Inventor: Timothy F. Tunstall, P.O. Box 434, Springfield, Mass. 01101-0434

[21] Appl. No.: 134,888

[22] Filed: Dec. 18, 1987

[30] Foreign Application Priority Data

Dec. 30, 1986 [IE] Ireland ..... 1747/86

[51] Int. Cl.[4] ..... A63B 53/04; A63B 53/08

[52] U.S. Cl. ..... 273/171; 273/167 H

[58] Field of Search ..... 273/171, 167 R, 167 F, 273/167 G, 167 H, 169, 170, 172, 173, 174

[56] References Cited

U.S. PATENT DOCUMENTS 1,840,924 1/1932 Tucker ..... 273/171
4,213,613 7/1980 Nygren ..... 273/171
4,325,553 4/1982 Taylor ..... 273/171
4,655,459 4/1987 Antonious ..... 273/171

*Primary Examiner*—George J. Marlo
*Attorney, Agent, or Firm*—Ross, Ross & Flavin

[57] ABSTRACT

A golf club has a head which may be selectively swing-weighted by the club owner to any swingweight he may desire. The base of the head is configured to define heel and toe portions at opposite ends and rearwardly of its ball-striking-face. The heel and toe portions are enlargements in each of which a weight-receiving bore is provided, each bore extending inwardly from the outboard end face of the respective heel or toe portion. A cylinder is extendable into each bore and held therein by means of a threaded engagement therewith. A selected number of swingweights and a packaging member are receivable in each cylinder.

2 Claims, 1 Drawing Sheet

GOLF CLUB

The present invention relates to a ball striking club, and in particular, though not limited to a golf club, and more particularly to a putter.

It is important that ball striking clubs, such as for example golf clubs, should be accurately balanced. This is particularly true of putters. However, by virtue of their construction, it has been difficult to ensure that the head of putters known heretofore is always accurately balanced. There is therefore a need for a putter, and a golf club, and indeed, any other ball striking club, which overcomes this particular problem.

The present invention is directed towards providing such a ball striking club.

According to the invention, there is provided a ball striking club comprising a head and a shaft attached to the head, and at least one recess being provided in the head to receive at least one weight therein.

In one embodiment of the invention, the recess is provided by a bore of circular cross section. Preferably, a cylinder closed at one end is engageable in the bore for retaining the weights in the bore.

Preferably, a portion of the outer peripheral surface of the cylinder is threaded to engage corresponding threads in the bore. Advantageously, a slot is provided in the closed end to accommodate a screwdriver or the like for engaging and disengaging the cylinder in the bore.

In another embodiment of the invention, a plurality of weights are provided, the weights being adapted to sit in the cylinder. Advantageously, the weights are provided by circular discs and correspond to swing weight increments, or portion of a swing weight increment.

In another embodiment of the invention, a compressible resilient member is provided in the bore of the cylinder to prevent the discs from rattling therein.

In another embodiment of the invention, a bore is provided in the toe and heel of the club head. Advantageously, the head comprises a base face for passing over the ground, and a pair of side faces extending upwardly therefrom, the toe and heel bores extending into the club head from the side faces.

In a further embodiment of the invention, the putter comprises a base member forming the base face and a ball striking member extending upwardly therefrom, which forms a face to strike the ball, and a pair of spaced apart side portions extending rearwardly of the ball striking member to accommodate the bore.

Preferably, the head is formed in one piece, and advantageously, from manganese bronze.

In a further embodiment of the invention, a shaft receiver extends upwardly of the head to engage the shaft.

In one embodiment of the invention, the club is a putter, and in another embodiment of the invention, it is a golf club.

Additionally, the ball striking club comprises a club head and a shaft connected to the club head, so that as the shaft is balanced about a fulcrum, a ball striking face of the club head is substantially horizontal. Preferably, the shaft is connected to the club head by a hosel assembly, the center line of the shaft extending from the shaft, passing across the club head intermediate the toe and heel thereof. Advantageously, the center line passes across the club head intermediate the weight receiving recesses. Advantageously, the center line of the shaft is forwardly offset of the ball striking face of the club. Preferably, the shaft is inclined at an angle to the club head. In another embodiment of the invention, the hosel assembly comprises a cranked member. Advantageously, the hosel assembly comprises an upper and lower portion, one being offset from the other by an offsetting bracket. In another embodiment of the invention, the club is a putter.

The invention will be more clearly understood from the following description of an embodiment thereof, given by way of example only, with reference to the accompanying drawings, in which.

Figure 1:
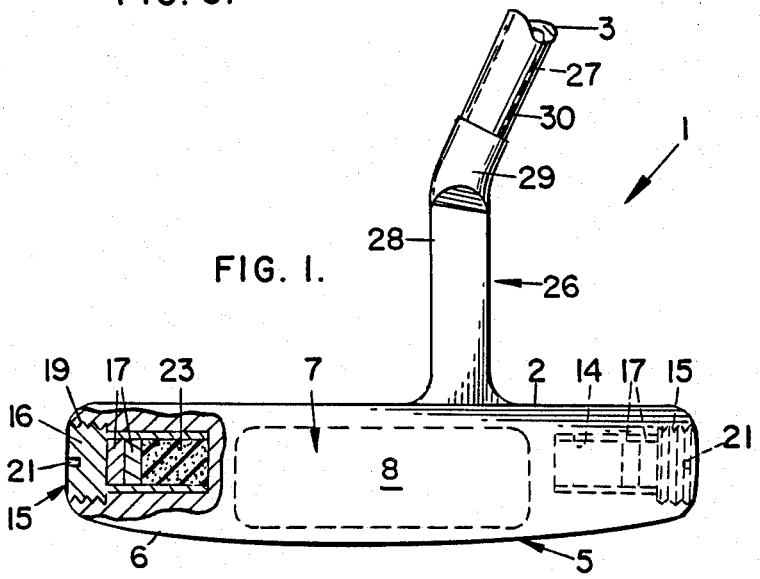
FIG. 1 is a front elevational view of a putter according to the invention.

Referring to the drawings, there is provided a ball striking club, in this case, a putter according to the invention, indicated generally by the reference numeral 1. The putter 1 comprises a head 2 and a shaft 3, only a portion of which is illustrated. The head 2 is cast in one piece of manganese bronze. It comprises a base 5 which forms a base face 6 which, as can be seen in FIG. 1, is radiused. A ball striking member 7 extends upwardly from the base 5, and forms a face 8 for striking a ball. A pair of spaced apart side portions 9 extend rearwardly from the member 7 at the heel 11 and toe 12 of the head 2 and define a hollow space therebetween rearwardly of the striking face. A pair of weight receiving bores 14 of circular cross section are formed in the side portions 9 and extend inwardly from the side faces of the toe 12 and heel 11. Cylinders 15 closed at one end 16 receive and support swing weights 17. Threads 19 on the cylinders 15 engage corresponding threads 20 in the bores 14. A slot 21 is provided in the closed end 16 of each cylinder 15 to accommodate a screwdriver, coin or the like for engaging or disengaging the cylinders 15 in the bores 14. A compressible resilient member 23 is provided to prevent the swing weights 17 rattling in the cylinders 15 or the bores 14. In this case, the members 23 are of synthetic foam rubber.

Figure 4:
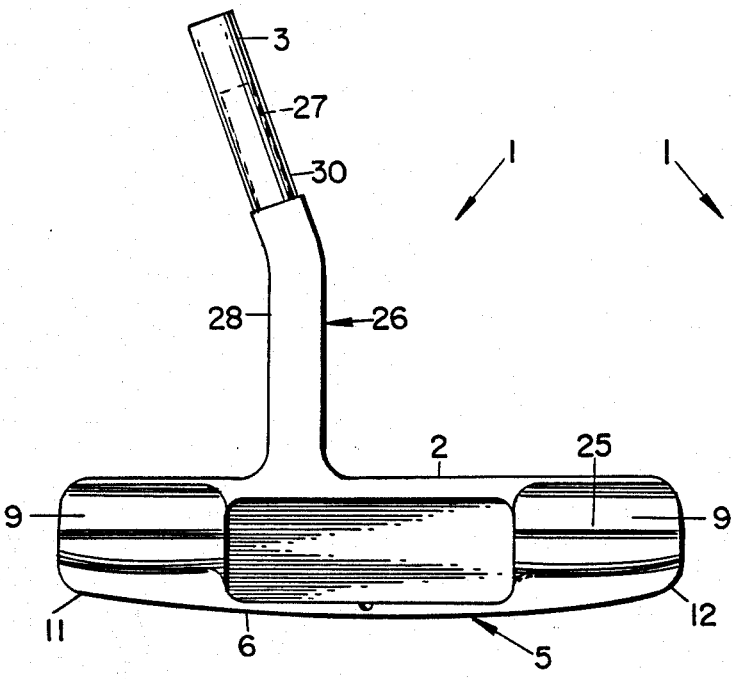
FIG. 4 is a rear elevational view of the putter of FIG. 1.
Figure 2:
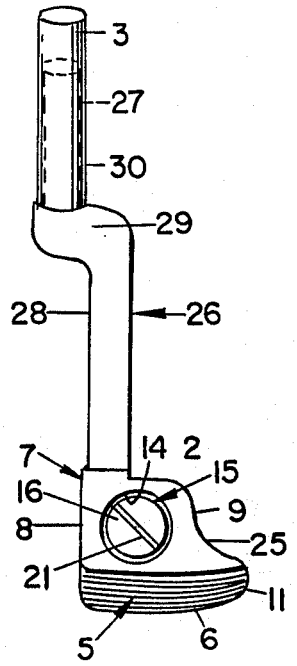
FIG. 2 is a side view of the putter of FIG. 1.
Figure 3:
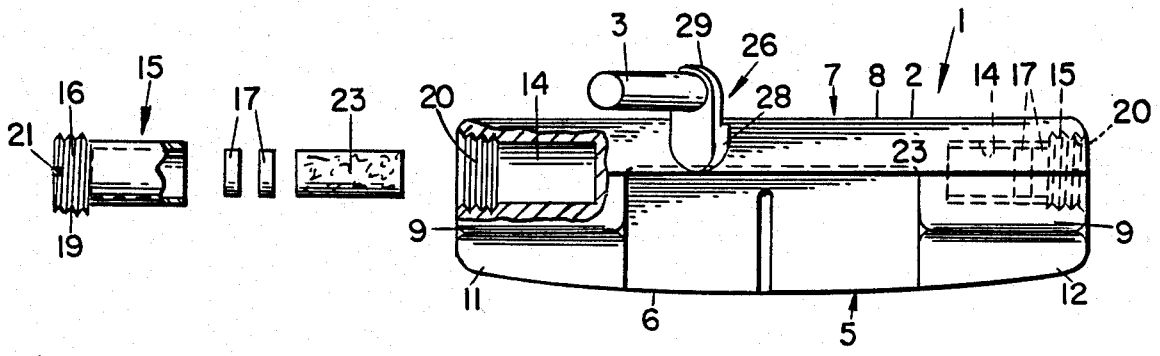
FIG. 3 is an exploded top plan view of the putter of FIG. 1.
Figure 5:
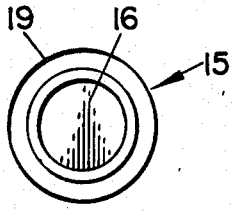
FIG. 5 is an end elevational view of one of the cylinders of the putter of the invention.
Figure 7:
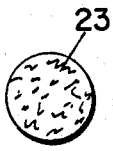
FIG. 7 is an end elevational view of one of the compressible resilient members of the putter of the invention.
Figure 6:
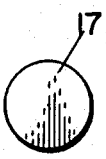
FIG. 6 is an end elevational view of one of the swing weights of the putter of the invention.

As can be seen, the rear portions 25 of the side portions 9 are radiused as illustrated in FIG. 2. A hosel assembly 26 extends upwardly from the ball striking member 7 to receive the shaft 3. An upper portion 27 of the hosel assembly 26 is offset from a lower portion 28 by a bracket 29. The portion 27 forms a male portion to engage a female portion 30 at the end of the shaft 3. The shaft 3 may engage the portion 27 by any suitable means, for example it may be a pressfit, it may be threaded, secured by adhesive or the like.

In use, the player increases or decreases the number of swing weights in each cylinder 15, until the club is balanced to suit the players stroke. The number of weights in the toe and heel bores are also varied, so that the weight distribution in the club head balances the head of the club. When the balancing has been achieved, the putter is then ready for use. To insert or remove swing weights, the appropriate cylinder or cylinders 15 are removed from the bores using a suitable coin or screwdriver engaged in the slot 21. When the desired number of swing weights have been placed in the cylinders 15, the resilient member 23 is then placed on top of the swing weights 17 and the cylinders are then engaged and secured in the bores 14.

In this particular embodiment of the invention, the swing weights are in predetermined increments of similar value. However, it is envisaged that swing weights which are equivalent to a whole number of swing weight increments may be provided, as of course swing weights which would be a fraction of the weight of each increment.

In the normal course of events, each putter during production will be swing weighted to a specific swing weight balance, with the cylinders 15 and resilient members 23 in place. Thus, from this point, the swing weights 17 can be installed by the player, to allow the player to increase the swing increments. In this way, a player can derive by calculation the total swing weight of a club without the use of scales. Also by referring to a manufacturers chart, which will be provided, the player can denote to a very precise degree the nominal total club weight.

The advantages of the invention are many; however, one particular advantage is that the putter, while accommodating the precise weight required by the player, also acts to balance the weight distribution in the club head to complement the players putting stoke. This is achieved by having toe and heel weight receiving bores. By having the weight in the putter head balanced in relation to the arc of the swing, the putter face strikes the ball in a way that is perpendicular to the target line. This adds considerably to the accuracy of the putting stroke.

Another important advantage of the invention is that by virtue of the construction of the putter head, and the hosel assembly, if the putter is balanced about a fulcrum on the shaft, the ball striking face of the putter is horizontal. This is achieved by the weight distribution in the putter head and by virtue of the fact that the center line of the shaft extended passes across the putter intermediate the ends thereof. Furthermore, it is believed that it is achieved by virtue of the fact that the center line of the shaft is forwardly offset of the ball striking face. A particular advantage of this feature of the invention is that by virtue of the fact that the putter is so balanced, there is no tendency for the putter head and shaft to tend to twist in a players hand during a swing. Thus, it can be said that the putter according to the present invention resists any tendency to twist during a stroke. This, as mentioned above, is essentially achieved by virtue of the weight distribution of the putter and the position of the shaft relative to the putter. However, needless to say, it will be appreciated that by using other weight distributions, and also by using different constructions of hosel assembly for connecting the shaft to the putter, this effect could also be achieved without departing from the scope of the invention. It has also been found that as a result of the construction of the putter according to the present invention, before any swing weights are added to the swing weight recesses, the putter is balanced so that the putter face lies horizontal when the putter is balanced about a fulcrum of the shaft.

While the putter has been described as comprising a pair of side portions to accommodate the swing bores, that is not necessary, the putter head could be formed as a block, and the swing weight bores would extend from each side face.

Needless to say, in certain cases, it is envisaged that the swing weight bores may extend from the top, bottom or rear face or indeed in certain cases, the front face of the putter head adjacent the toe and heel thereof. It will also be appreciated that while a particular construction of resilient member has been described, any other suitable compressible or resilient member could be provided, for example, in certain cases, a compression spring, pneumatic spring or the like may be provided. Further, it is envisaged that in certain cases the cylinders may be dispensed with, and a plug may be provided to close the ends of the bores and retain the swing weights therein.

It is also envisaged in certain cases that materials other than manganese bronze may be used for the putter head.

Needless to say, other suitable construction of hosel assembly may be provided to receive the shaft. In fact, in certain cases, it is envisaged that the shaft may directly engage the club head.

Indeed, of course, it will be appreciated that while the base face of the club head has been radiused, any other suitable construction, configuration or shape of the base face could be provided. Similarly, different profiles of rear faces could also be used.

Additionally, it is envisaged in certain cases that the cylinders may be so formed as to be of a weight which is a multiple of the swing weights. Similarly, the resilient member may be of a weight equivalent to a swing weight, or a fraction thereof. In certain cases, the combination of the cylinder and resilient member could be of a weight equivalent to a multiple of the swing weights.

It is also envisaged that as well as providing a putter, the invention could be used for any type of golf club, whether it be a chipper, a driver, a wedge or the like. Indeed, it could be used for any ball striking club.

The invention is not limited to the embodiments hereinbefore described which may be varied in construction and detail.

I claim:

1. In a perimeter-weighted putter consisting of a shaft and a head interconnected by a hosel, the improvement in means for controlling the ultimate degree of perimeter weighting of the head, the head comprising:

a foot having a lower face shaped with a convex curve, a ball-striking member extending upwardly from and integral with the foot and presenting a forwardly-facing vertically-disposed striking-face, a pair of spaced-apart side portions extending rearwardly from the ball-striking member and defining respectively a heel and a toe extending inwardly from the respective outboard end face of the side portion and defining a hollow space therebetween and rearwardly of the striking face, a pair of coaxially-aligned weight-receiving threaded cylindrical recesses each formed at the outboard end of one of the side portions and extending inwardly from the end faces of the toe and heel respectively, the shaft center line being extendable from the shaft intermediate said heel and toe thereof and with the shaft center line being offset forwardly of the vertical plane of the striking face, a pair of threaded capsules each receivable in and in threaded engagement with a respective recess, and a plurality of quantifiable incrementally-weighted discs variably receivable in each of the capsules facilitating a weight distribution in the head according to the desire of the individual user.

2. In a perimeter-weighted putter consisting of a shaft and a head interconnected by a hosel, the improvement in means for controlling the perimeter weighting of the head, the head comprising:

a ball-striking member presenting a forwardly-facing vertically-disposed striking-face, a pair of spaced-apart side portions integral with and extending rearwardly from the ball-striking member and defining respectively a heel and a toe extending inwardly from the respective outboard end face of the side portion and defining a hollow cavity therebetween and rearwardly of the striking face, a pair of coaxially-aligned weight-receiving threaded recesses each formed at the outboard end of one of the side portions and extending inwardly from the end faces of the toe and heel respectively, the shaft center line being extendable from the shaft intermediate said heel and toe, a pair of threaded capsules each receivable in and in threaded engagement with a respective recess, a plurality of quantifiable incrementally-weighted discs variably receivable in each of the capsules facilitating a weight distribution in the head according to the desire of the individual user, and a compressible member receivable in each capsule for maintaining the weights in the respective capsule in a tight relationship therewithin.

* * * * *